US006575455B2

(12) United States Patent
Thøgersen et al.

(10) Patent No.: US 6,575,455 B2
(45) Date of Patent: Jun. 10, 2003

(54) APPARATUS FOR INVERTING AND RETURNING SHEETS FROM A PRINTER FOR LARGE-SIZED PAPER

(75) Inventors: Klaus Thøgersen, Charlottenlund (DK); Rolf Steno, Bagsværd (DK); Erik Kasper, Malling (DK)

(73) Assignee: Teknologi & Produkt Udvikling A/S, Holte (DK)

( * ) Notice: Subject to any disclaimer, the term of this patent is extended or adjusted under 35 U.S.C. 154(b) by 0 days.

(21) Appl. No.: 10/257,094

(22) PCT Filed: Apr. 10, 2001

(86) PCT No.: PCT/DK01/00250

§ 371 (c)(1),
(2), (4) Date: Oct. 8, 2002

(87) PCT Pub. No.: WO01/79097

PCT Pub. Date: Oct. 25, 2001

(65) Prior Publication Data

US 2003/0052442 A1 Mar. 20, 2003

(30) Foreign Application Priority Data

Apr. 14, 2000 (DK) ..... 2000 00634

(51) Int. Cl.[7] ..... B65H 29/00
(52) U.S. Cl. ..... 271/186
(58) Field of Search ..... 271/186; 399/364

(56) References Cited

U.S. PATENT DOCUMENTS

| | | | | |
|---|---|---|---|---|
| 4,019,435 A | | 4/1977 | Davis | 101/232 |
| 4,412,740 A | | 11/1983 | Buddendeck et al. | 355/14 SH |
| 4,623,900 A | | 11/1986 | Watanabe | 346/76 PH |
| 4,884,794 A | | 12/1989 | Dinatale et al. | 271/3 |
| 4,903,043 A | | 2/1990 | Tajima | 346/134 |
| 5,337,134 A | | 8/1994 | Sato et al. | 355/319 |
| 5,438,435 A | * | 8/1995 | Lawniczak | 358/496 |
| 5,597,105 A | | 1/1997 | Keller | 226/118 |
| 6,018,640 A | * | 1/2000 | Blackman et al. | 399/364 |
| 6,103,985 A | * | 8/2000 | Shell et al. | 209/587 |

FOREIGN PATENT DOCUMENTS

| | | | | |
|---|---|---|---|---|
| EP | 0367628 | | 5/1990 | B65H/15/00 |
| EP | 0475333 | | 3/1992 | G03G/15/00 |
| JP | 64-17725 | * | 1/1989 | B65H/1/30 |
| JP | 4-32457 | * | 2/1992 | B65H/31/00 |
| SE | 515036 | | 6/2001 | B41F/33/00 |

* cited by examiner

*Primary Examiner*—Donald P. Walsh
*Assistant Examiner*—Kenneth W Bower
(74) *Attorney, Agent, or Firm*—Cooper & Dunham LLP; Donald S. Dowden

(57) ABSTRACT

An apparatus for inverting and returning sheets from a printer (1) for large-sized paper comprises an inlet area (11) where the sheet is received from the printer (1), and an outlet area (12) where said sheet is returned to the printer (1). The apparatus comprises a frame (16) mountable on the support of the printer (1), and a guiding slit (18) in the inlet area, said guiding slit being defined by an upper wall (13) and a lower wall (17), where the lower wall (17) extends from the inlet (11) to a clamping slit (22) between a first pair of roller means (23, 24) for receiving and temporarily retaining the front edge of a sheet when seen in the advancing direction, said sheet being received through the inlet area. The lower guiding wall (17) is tiltable and adapted to be moved about a substantially horizontal axis from a sheet-supporting position to a downward sheet-releasing position. The frame (16) carries furthermore a second pair of roller means (33, 24) adapted to received the sheet from the first pair of roller means (23, 24) and to guide the sheet through the outlet area (12) and back to the printer (1).

12 Claims, 15 Drawing Sheets

APPARATUS FOR INVERTING AND RETURNING SHEETS FROM A PRINTER FOR LARGE-SIZED PAPER

TECHNICAL FIELD

The invention relates to an apparatus for inverting and returning sheets from a printer for large-sized paper, said apparatus comprising an inlet area where the sheet is received from the printer, and an outlet area where said sheet is returned to the printer, a front edge of the sheets remaining in front during the receiving, inverting and returning movement of said sheets.

BACKGROUND ART

Various printers for large-sized paper are known, such as for instance the HP Designjet 1050C/1055CM. Such printers are primarily used for simplex printing, viz. printing on one side of the paper, and they are often used for the production of samples of for instance posters before the final printing is initiated. The paper is available in form of separate sheets fed manually into the printer from the front side of said printer, or it is available in form of rolls fed into the printer through a suitable inlet and cut off therein in the desired length, said length being variable according to desire. After the printing procedure, the paper usually falls into a tray or basket arranged below the printer, said tray or basket being secured to the support of the printer.

Sometimes duplex printing is required, viz. printing on both sides of the paper, and then it is necessary to invert the paper, which, of course, can be carried out manually, but various possibilities of automating said inverting procedure apply as well. Some printers allowing such a duplex printing comprise two printer sections for initiating the printing on each side of the paper. Other printers comprise a built-in sheet inverter integrated in the inlet area of the printer with the result that it obstructs the passage of the sheet when said sheet is to be returned to the tray.

BRIEF DESCRIPTION OF THE INVENTION

The object of the invention is to provide an apparatus for inverting and returning sheets to a printer, where said apparatus is mounted independent of the printer and accordingly does not obstruct the usual operation of the printer during the printing on only one side, and where said apparatus furthermore can be mounted on an existing printer, such as a printer of the type described above, in a relatively easy manner.

The apparatus according to the invention comprises a frame mountable on the support of the printer, and a guiding slit in the inlet area, said guiding slit being defined by a downward surface on an upper guiding wall and an upward surface on a lower guiding wall, where said upward surface having a downwardly curving profile extends from the inlet area to a clamping slit between a first pair of roller means, whereby the lower guiding wall is tiltable and adapted to be moved about a substantially horizontal axis from a sheet-supporting and -forming position in which the guiding slit is formed and into a downwardly extending sheet-releasing position, where in use the outlet area is placed over and adjacent the inlet area, and where the frame carries a second pair of roller means adapted to receive the sheet from the first pair of roller means and to guide the sheet through the outlet area and back to the printer.

As a result the inverting of a sheet can be carried out completely outside the printer, and the resetting of the printer to an inverting of the sheet or to an ordinary use can be controlled merely by moving the lower guiding wall between its two operational positions while it is simultaneously possible to move the entire sheet out of the printer before it is returned to the printer again. The latter is in particular achieved by the front edge of a sheet to be inverted being advanced to and retained in the clamping slit between the first pair of roller means, whereafter the lower guiding wall is moved out of its sheet-supporting position and allows said sheet to be moved outwards into an increasing, downward loop in the area between the outlet of the printer and the first pair of roller means until the rear end of said sheet falls out and downwards into the area below the printer where a basket is preferably provided. Subsequently, the sheet is pulled upwards and fed into the printer again by an activation of the roller means.

According to the invention it is particularly advantageous when the apparatus comprises an idler roll adapted to abut the top side of a sheet between the inlet area and the first pair of roller means after the front edge of the sheet has been gripped by the first pair of roller means and the lower guiding wall has been tilted downwards into the downwardly extending position, said idler roll being supported by the sheet and following said sheet in its downwardly curving free path as said sheet leaves the printer. As a result it is ensured that the sheet does not form folds substantially longitudinal to said sheet when seen in the advancing direction thereof, especially due to various degrees of moisture applied during the printing when seen in the transverse direction of said sheet.

According to the invention the idler roll may be suspended in a spring means ensuring that the idler roll subjects the sheet to a force weaker than the force originating from the weight of said idler roll, said spring means being connected to a driving means for retracting the idler roll into its uppermost starting position when the rear end of the sheet has passed the inlet area and has fallen down. In this manner it is avoided that the effect of the idler roll on the paper is restricted, and that said idler roll is easily returned to its starting position.

The two pairs of roller means may according to the invention particularly advantageously comprise a common roller and be driven by means of the roller means of the first pair of roller means co-acting therewith, whereby a simple control of the operation of the roller means is obtained.

According to the invention the apparatus comprises advantageously a first sensor for detecting the arrival of the front edge of a sheet immediately before said edge reaches the clamping slit between the first pair of roller means, and for activating said first pair of roller means so as to grip and advance said edge a short distance. As a result a high security is obtained that the first pair of roller means achieves a good grip in the front end of the sheet before the lower guiding wall is moved out of the sheet-supporting position.

Correspondingly the apparatus may according to the invention comprise a second sensor for detecting that the rear end of the sheet has left the printer. In this manner the returning of the above roller to its uppermost position and the further returning of the sheet to the printer are controlled in a simple manner.

Moreover, a measuring device may according to the invention be provided in connection with the second pair of roller means for registering the length of the sheet. As a result it is possible to efficiently monitor the operation of the apparatus despite a varying resistance relative to the advancing of various lengths of sheets and weights of paper etc. in such a manner that it is always positively known when the front end of the sheet has reached a specific predetermined location in the printer during the advancing and when said advancing by means of the roller means is to be stopped.

Furthermore, the driving roller means may according to the invention be provided with overrunning clutches so as to ensure that the sheet can be freely pulled forwards in the advancing direction when the advancing device of the printer starts to advance the inverted sheet. In this manner it is avoided that the sheet is destroyed due to the effect of various advancing speeds.

Moreover a redirecting member may according to the invention be provided at the guiding slit, said redirecting member being adapted to direct the front edge of a sheet downwards and into the guiding slit at the arrival from the printer, whereby the paper is reliably fed into said guiding slit. The latter is of particular importance when the paper originates from a roll and accordingly has a tendency to bend upwards in a direction away from the guiding slit.

The redirecting member may according to the invention particularly advantageously comprise a Z-shaped sectional guide freely pivotally journalled about a horizontal axis above the outlet area, where the body of said Z-shaped sectional guide in the rest position extends obliquely downwards and abuts by its lower end the edge of the upper guiding wall of the guiding slit adjacent the printer, and together with this guide rail it forms an acute angle facing the outlet area while the lower web of the sectional guide projects obliquely upwards from the guiding wall towards the printer. According to its size the upper web ensures a good balancing of the sectional guide.

The frame may according to the invention be tiltably and detachably mounted on the support of the printer in such a manner that an easy access applies to the side facing the printer.

Finally, a further guide may according to the invention be provided between the two pairs of roller means and the second pair of roller means and the outlet area, respectively, in such a manner that an efficient guiding of the sheet during the advancing thereof is obtained.

BRIEF DESCRIPTION OF THE DRAWINGS

The invention is explained in greater detail below with reference to the accompanying drawings, in which.

BEST MODE FOR CARRYING OUT THE INVENTION

Figure 1:
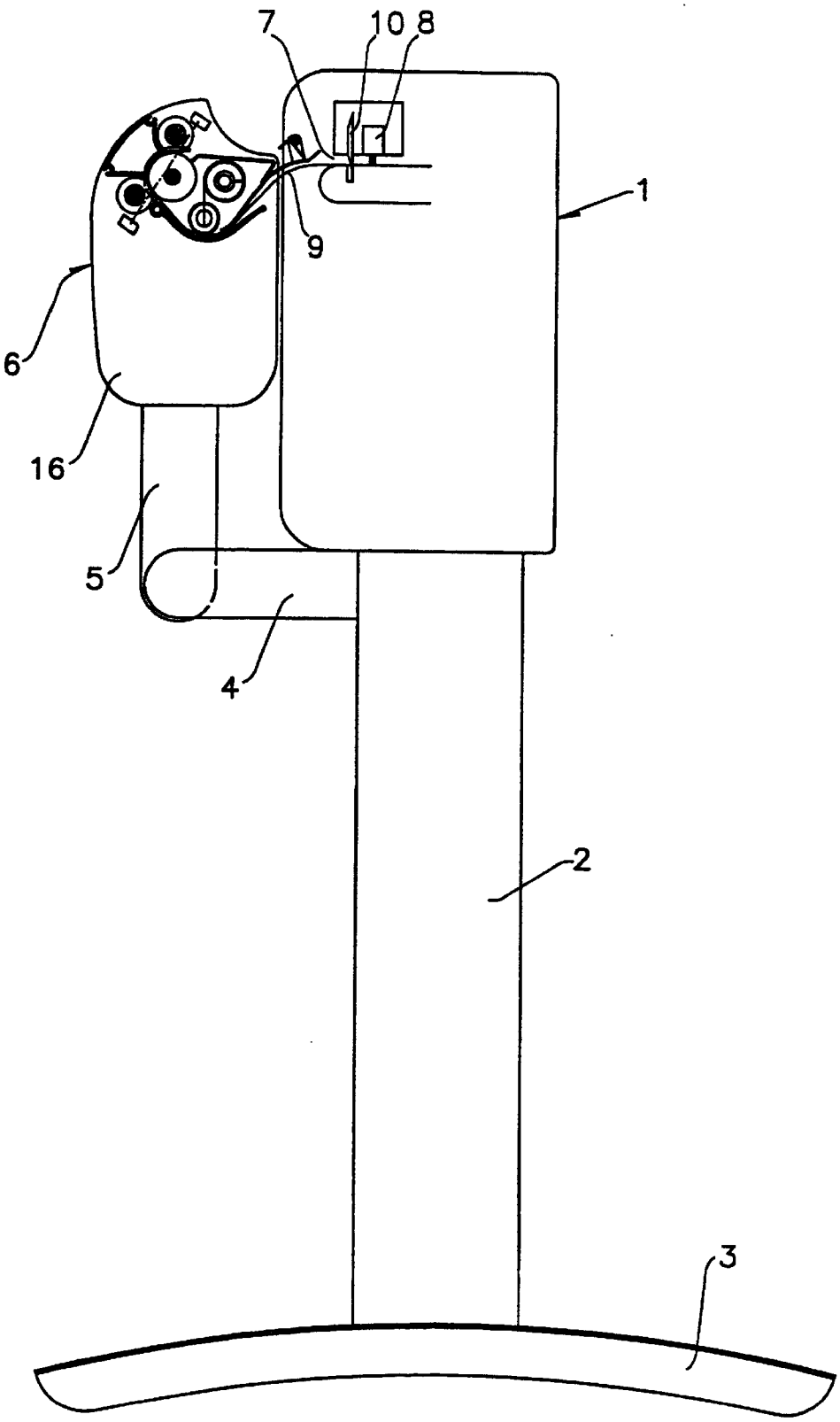
FIG. 1 is a diagrammatic side view of a printer with an apparatus according to the invention, where parts have been removed for the sake of clarity.

FIG. 1 illustrates a printer designated the general reference numeral 1 and comprising a support 2 with a base 3. An apparatus according to the invention for inverting a sheet of paper from the printer is secured to the support 2 through a hinge connection with two arms 4, 5. This apparatus is designated the general reference numeral 6. The printer is of a conventionally known type with a front provided with an oblong slit 7 opening on to the printer unit 8 which provides a sheet or a length 9 of paper with a print while it leaves the printer.

The printer comprises its own paper handling equipment in a conventionally known manner, said paper handling equipment being of a conventionally known type and accordingly not being illustrated and described in greater detail. When the paper originates from a roll of paper, it is cut off after the printing in suitable, predetermined lengths by means of a cutting device 10. Below the paper to be handled is throughout referred to as a sheet although in some situations it has not yet been cut off by means of the cutting device 10.

Figure 8:
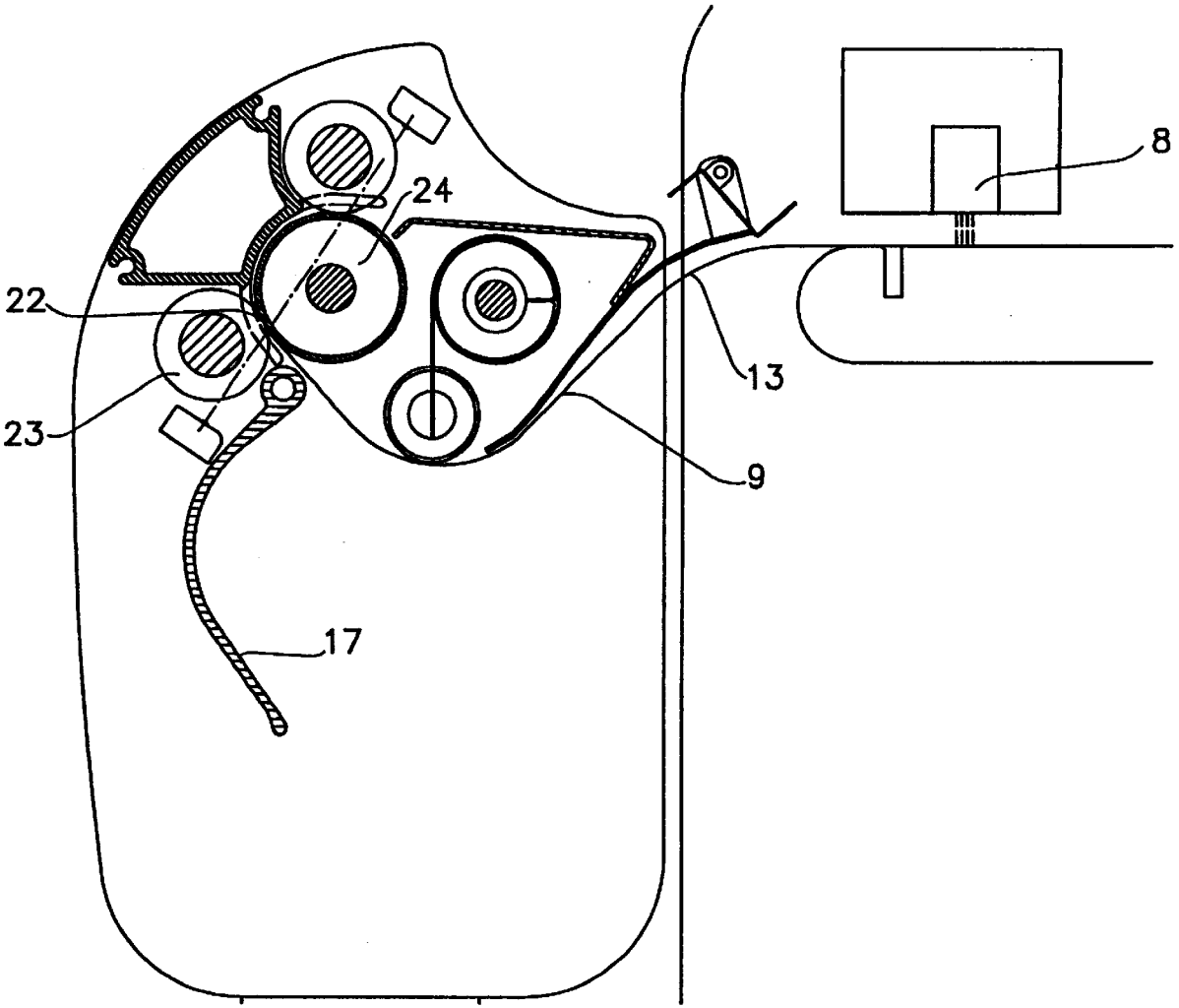
FIG. 8 illustrates a subsequent situation, where a sheet-supporting guiding wall has been moved downwards into a downwardly extending sheet-releasing position, FIG. 9 corresponds to FIG. 8, but where the sheet is about to form a downwardly curving fold while leaving the printer, FIG. 10 corresponds to FIG. 9, but in a situation where the rear end of the sheet is cut off by means of a cutting device inside the printer.
Figure 15:
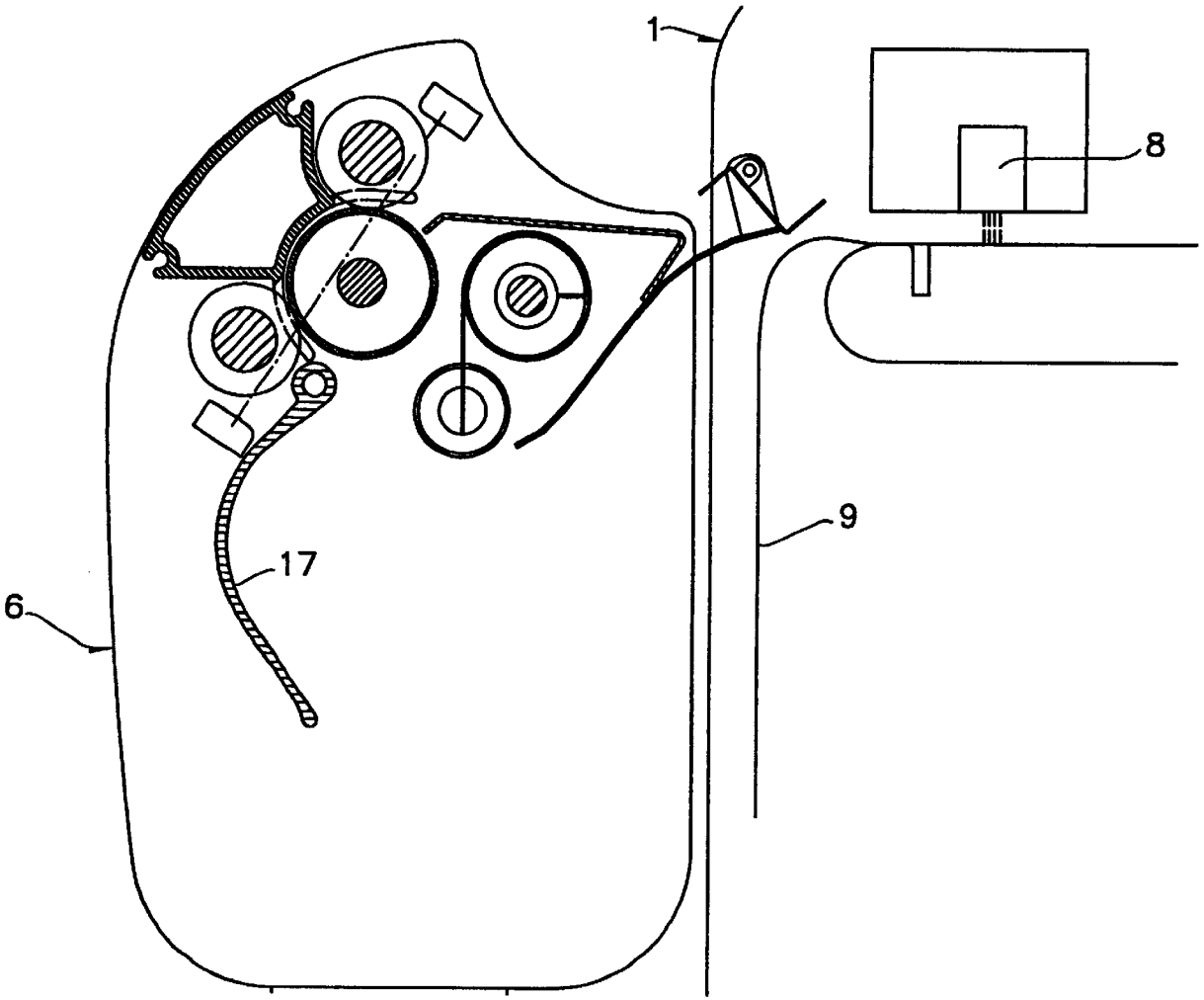

The printer in question is of such a type that it is intended for large-sized paper, i.e. paper widths of preferably 60 to 100 cm. The apparatus 6 is arranged such relative to the slit 7 of the printer that its opposing inlet area 11 and outlet area 12 are positioned opposite the slit 7 of the printer. The inlet area 11 is defined by an upper stationary guiding wall 13 which is secured in a manner not described in greater detail at each end to the end walls 14, cf. FIG. 4, and 15 forming part of the frame 16 of the apparatus. This guiding wall 13 extends from an area opposite the slit 7 of the printer and obliquely downwards into the interior of the apparatus 6, and together with a pivotal or tiltable lower guiding wall 17 it defines a guiding slit 18 in the innermost area. This lower guiding wall 17 presents a curved profile in such a manner that in the state shown in FIG. 2 it curves downwards. At the inner end, the lower guiding wall is secured to a shaft 19 which is connected to the output shaft 21 of a motor 20 through a pulley drive on the outer side of the end wall 14 of the frame 16. As a result the lower guiding wall 17 is adapted to be moved between the position shown in FIG. 2 and the position inter alia shown in FIG. 8 in which it has been turned approximately 90°, and downwards into a position in which it is suspended freely substantially vertically downwards inside the apparatus 6. A clamping slit 22 is arranged between two roller means 23, 24 opposite the end of the lower guiding wall 17 adjacent the shaft 19. The first roller means 23 of these two roller means 23, 24 is a driving roller, and as illustrated in FIG. 3 this roller 23 is connected to the output shaft 27 of a motor 26 through a belt drive on the outside of the end wall 15 of the frame 16. The shaft 25 is connected to a pulley 28 through an overrunning clutch 29.

The roller means 23 comprises a plurality of rubber rings 30 arranged at suitable intervals along the shaft 25. These rubber rings 30 form the clamping slit 22 together with the second roller means 24. This second roller means 24 comprises a plurality of cylindrical walls 31 secured to a shaft 32, which in turn is freely pivotally journalled in a manner not described in greater detail, but such that it can be freely turned by the driving first roller means 23. When seen in the use position, a third roller means 33 is arranged at a level substantially vertically above the shaft 32 of the roller means 24. This third roller means 33 comprises a shaft 34, which is also free pivotally journalled in a manner not described in greater detail, but such that the second roller means 24 causes the third roller means 33 to rotate because they abut one another along their circumference.

A guiding profile 38 is mounted between the driving roller means 23 and the third roller means 33, said guiding profile 38 comprising an inner side 39' which extends coaxially about the axis of rotation of the second roller means 24 and at a short distance from the outer surface of said roller means 24. Guiding webs 39 and 40 extend from this inner side 39 of the guiding profile 38 and inwards between the rubber rings 30 on the driving roller means 23 and the third roller means 33, respectively, also at a short distance relative to the outer side of the second roller means 24. Finally, a guide rail 41 is provided, which comprises a surface extending substantially tangentially to the outer side of the second roller means 24 and forwards to the outlet area 12 of the apparatus and in a direction towards the slit 7 of the printer.

A Z-shaped guide rail 42 is provided in the area opposite the outlet area 12. At the ends this Z-shaped guide rail 42 is pivotally journalled on upwardly projecting brackets 43 secured to the upper guiding wall 13 which projects from the inlet area 11. The Z-shaped guide rail 42 is provided with an angular web at each end. These webs 44 individually engage a shaft member 45 on the upwardly projecting brackets 43 on the upper guiding wall 13. As illustrated inter alia in FIG. 2, the lower end of the Z-shaped guide rail 42 loosely abuts the end of the upper guiding wall 13 projecting towards the printer, whereas the lower web 46 of said guide rail 42 projects obliquely upwards in a direction away from the apparatus. The upper web 47 of the Z-shaped guide rail 42 projects obliquely downwards and inwards towards the apparatus 6, and it has a balancing effect on the Z-shaped guide rail 42 in such a manner that it can be turned counter-clockwise in a relatively easy manner when seen relative to FIG. 2, viz. out of the engagement with the upper guiding wall 13.

Figure 2:
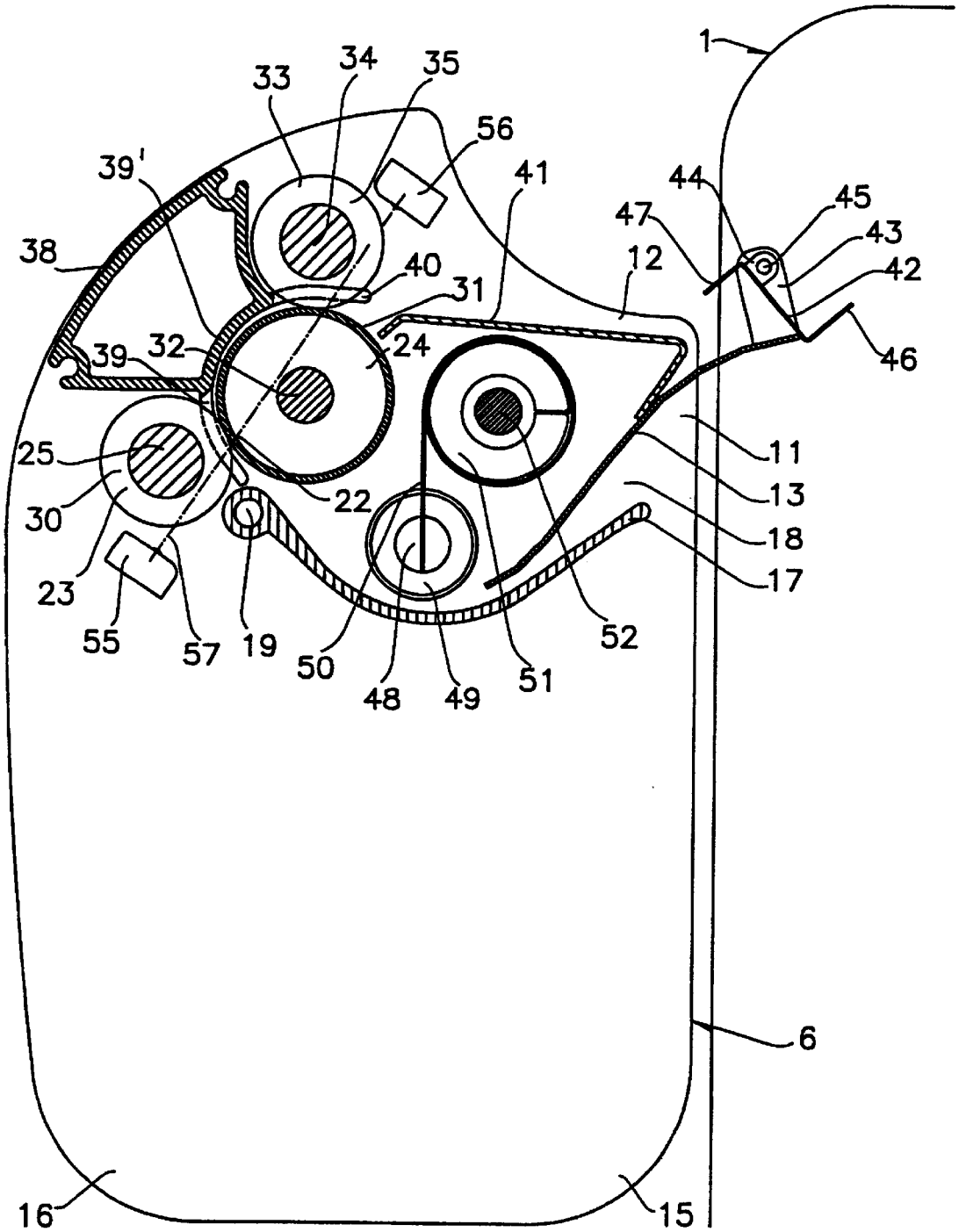
FIG. 2 illustrates on a larger scale a diagrammatic cross sectional view of parts of the apparatus according to the invention.
Figure 3:
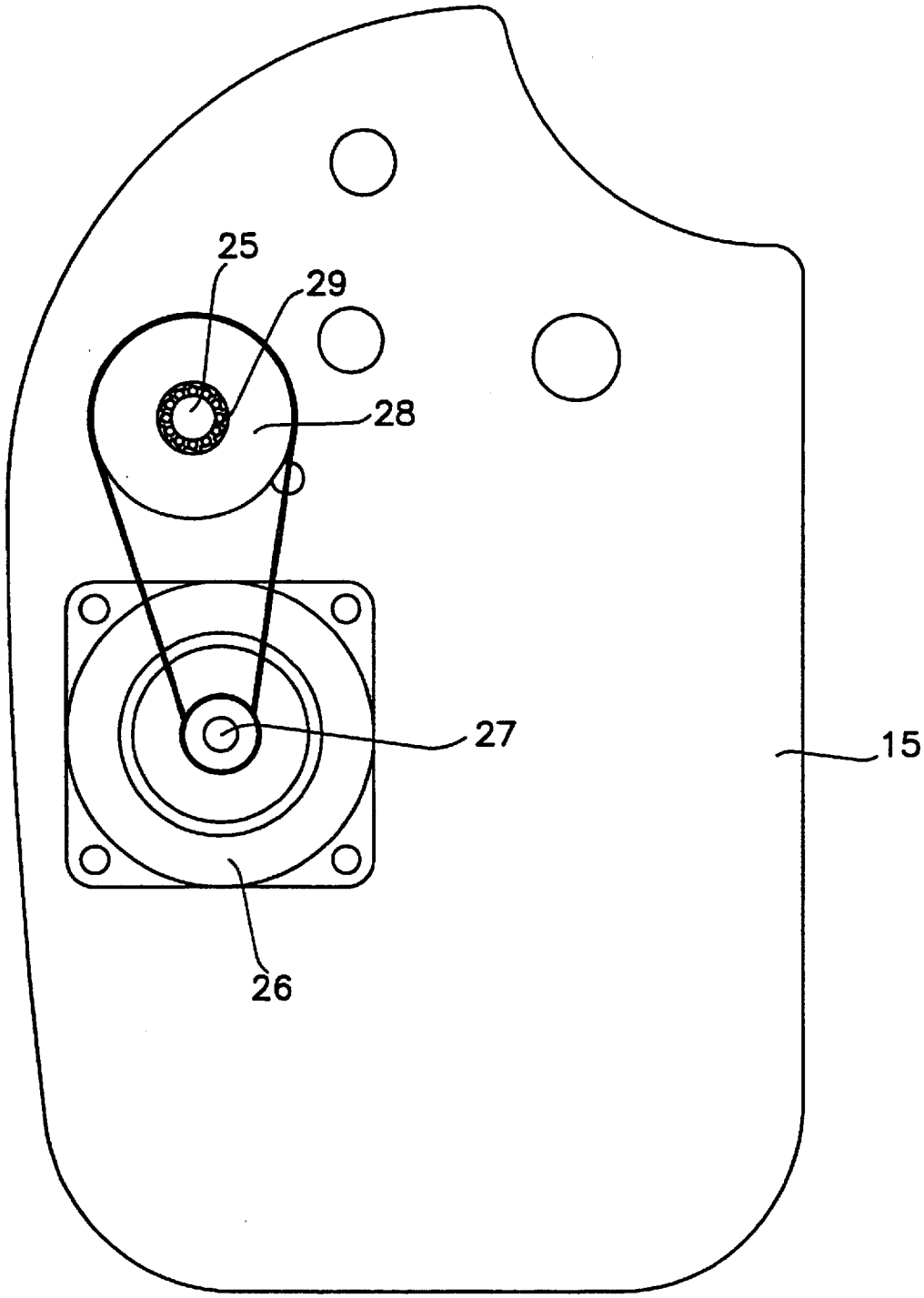
FIG. 3 is a side view of parts of the apparatus according to the invention.
Figure 4:
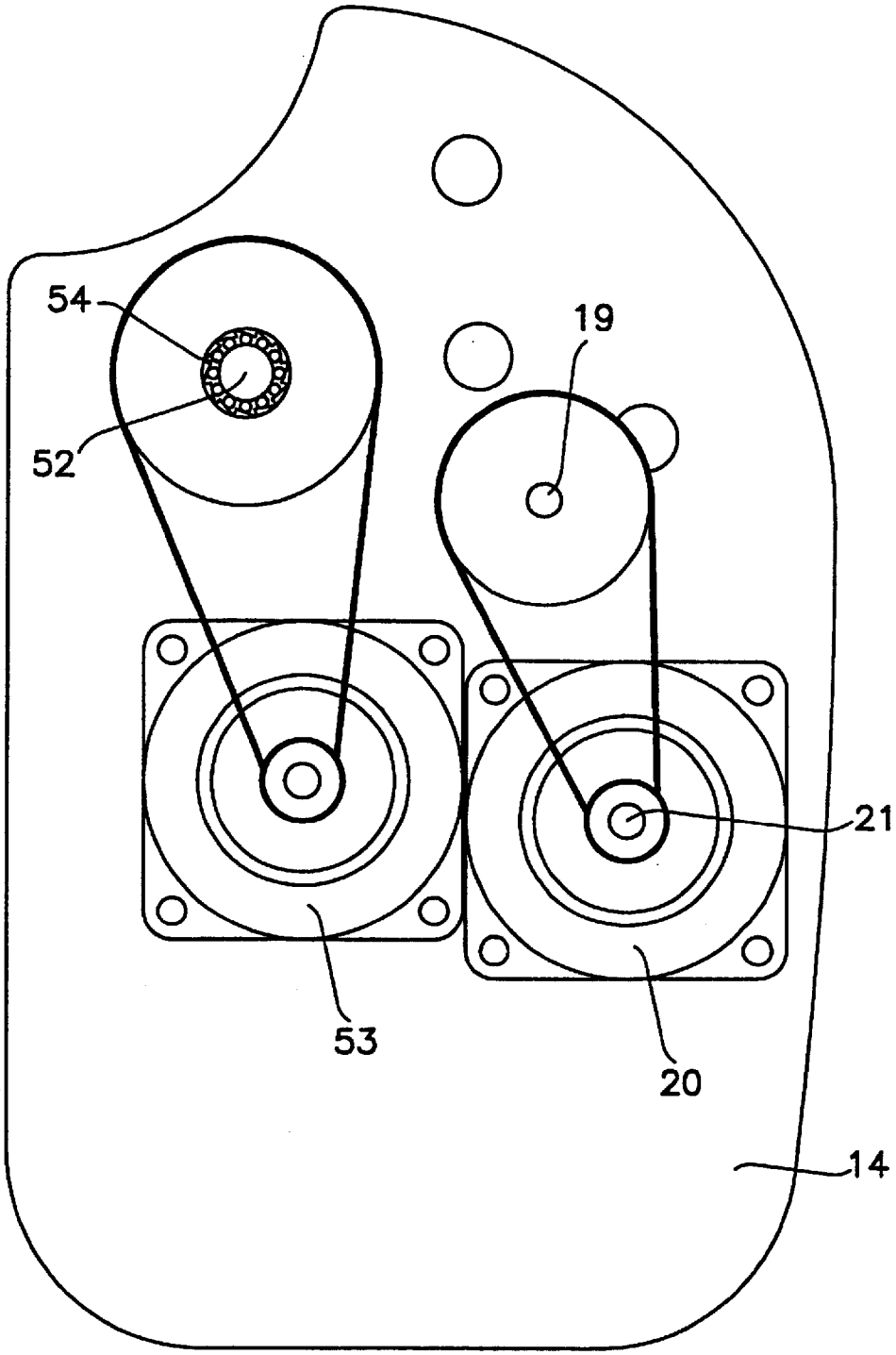
FIG. 4 illustrates parts of the apparatus seen from the opposite side.

A shaft 48 is arranged centrally above and at a short distance from the pivotally journalled guiding wall 17, cf. FIG. 2, said shaft 48 comprising a freely pivotally journalled roller 49. At each end this shaft 48 with roller 49 is suspended in a thin flat spring 50, which is wound in a helical manner about a cylinder 51 secured to a shaft 41. As illustrated in FIG. 4, this shaft is driven by a motor 53 on the outer side of the end wall 14 of the frame 16. The motor 53 is a reversible motor and the shaft 52 is connected to the belt drive through an overrunning clutch 54. The function of the roller 49 during the inverting process is described in greater detail below.

As indicated by means of a broken line in FIG. 2, a sensor 55, 56 is arranged immediately in front of the clamping slit 22 between the driving roller means 23 and the second roller means 24. These sensors 55, 56 detect whether a sheet 9 has reached the clamping slit 22 by means of a light beam 57 passing between the rubber rings on the driving roller means 23 and the third roller means 33 as well as a space in the cylindrical wall 31 on the second roller means 24.

When the apparatus 6 is mounted on the printer, the control system of the apparatus is connected to the control system of the printer in such a manner that the apparatus is set such that it is ready to initiate an inverting of a sheet when the user of the printer activates said printer to initiate the duplex printing, viz. the printing on both sides. Such a state appears from FIG. 2 and FIG. 5.

The use of the apparatus is now described with reference to FIGS. 5 to 15 showing the steps of the inverting process. As illustrated in FIGS. 2 to 5, the lower wall 17 is in a position where a theoretical line between its pivot shaft 19 and its opposite free end is substantially horizontal when seen relative to the cross section. Below this position is referred to as the horizontal position of the guiding wall 17, whereas when said theoretical line extends substantially vertically downwards the position is referred to as the vertical position of said guiding wall 17.

FIGS. 5 to 15 include only the reference numerals important for the description of the respective situation.

Figure 5:
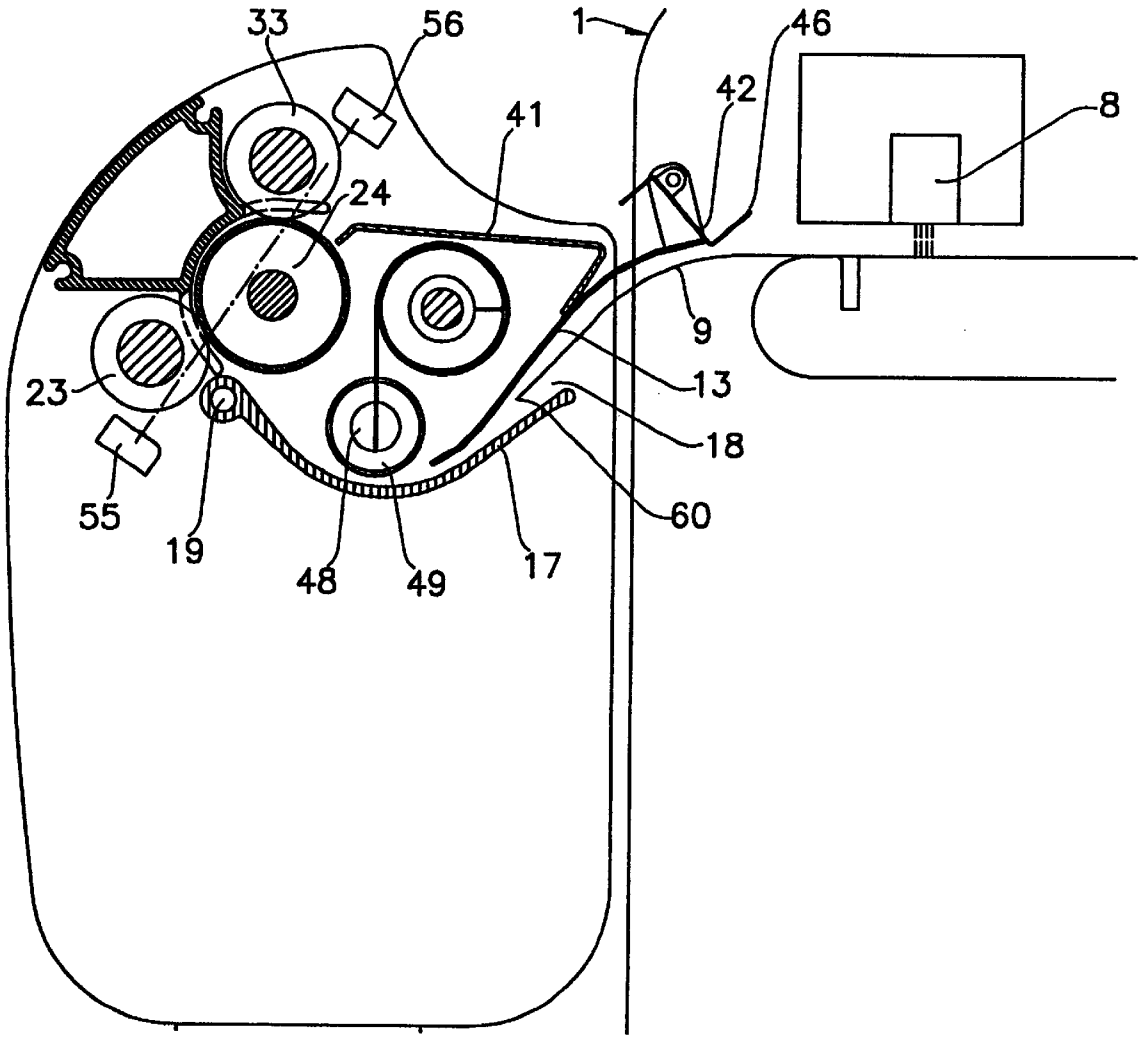
FIG. 5 illustrates on a larger scale the parts of FIG. 2, but where parts of the printer have been indicated and where the front edge of a sheet or length of paper appears entering the guiding slit of the apparatus, FIG. 6 corresponds to FIG. 5, but in a situation where the front end of the sheet has reached a clamping slit between a first pair of rollers, FIG. 7 corresponds to FIG. 6, but where the front end of the sheet enters the clamping slit between the first pair of rollers.
Figure 6:
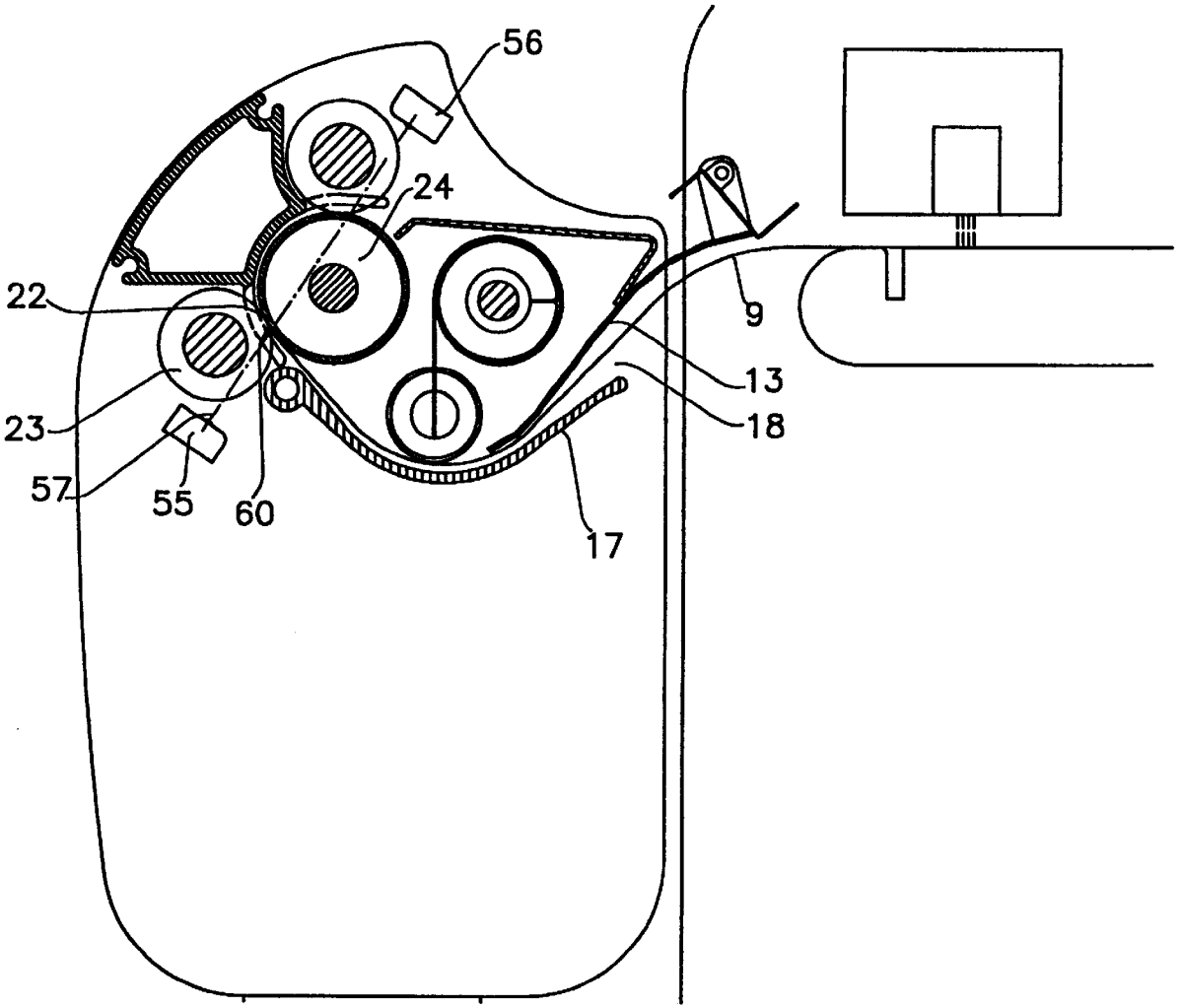
Figure 7:
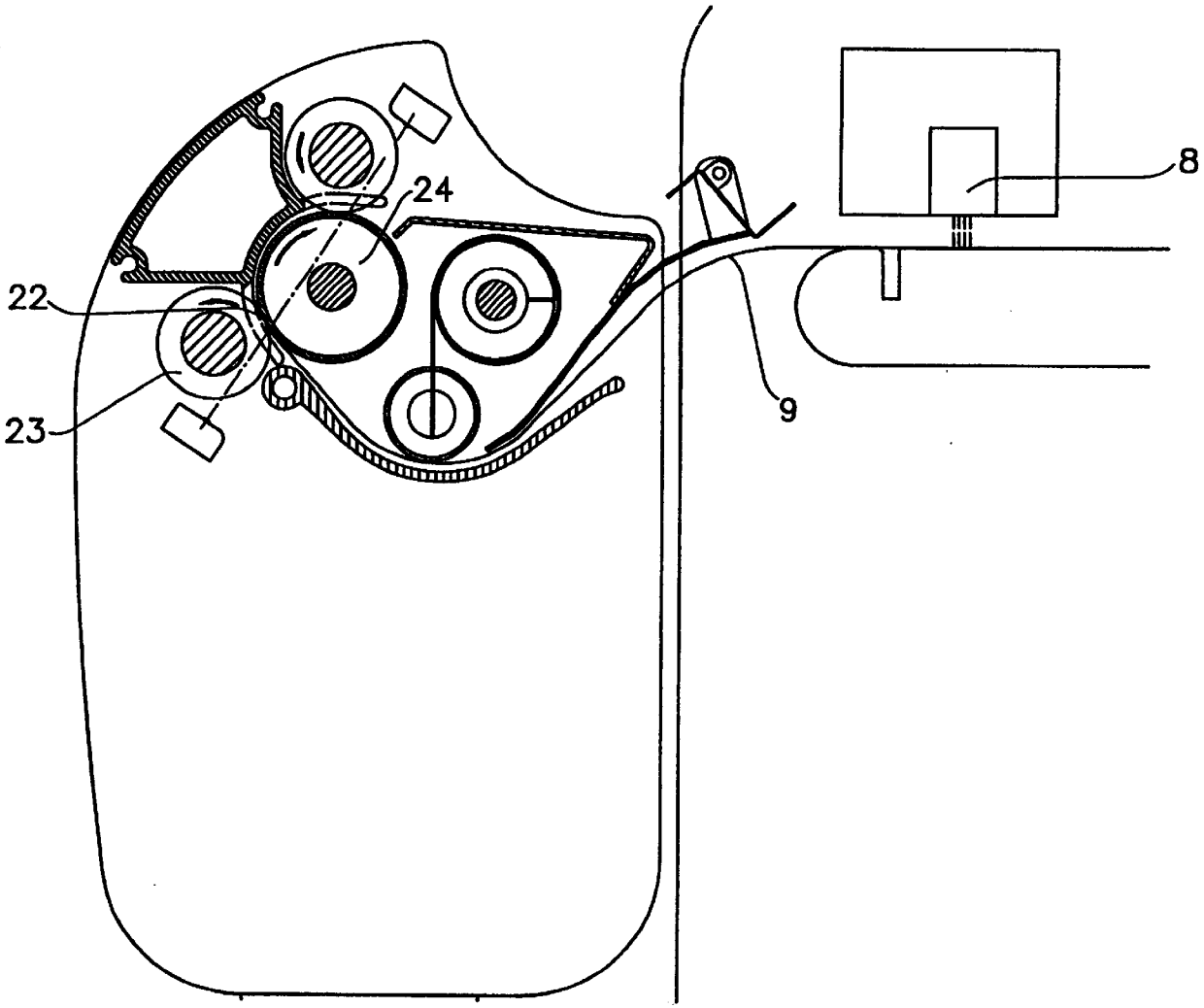

When the printer 1 has been activated to print on both sides of a sheet 9, said sheet 9 passes during the printing by means of the printer unit 8 by its front end 60 directly into the guiding slit 18 between the stationary upper guiding wall 13 and the lower tiltable guiding wall 17, cf. FIG. 5. During this passage and especially when the sheet originates from a roll and accordingly has a tendency to bend upwards, the front end 60 of the sheet hits the lower web 46 of the Z-shaped guide rail 42 and is thereby guided downwards below the upper guiding wall 13 and into the guiding slit 18. During the continued printing by means of the printer unit 8, the sheet 9 gradually reaches and enters the position shown in FIG. 6, in which the front edge 60 of the sheet 9 refracts the light beam 57 between the sensors 55 and 56. As a result, the driving roller means 23 and 24 are activated to drive the front end of the sheet 9 into the clamping slit 22 between the driving roller means 23 and the second roller means 24, cf. FIG. 7. This advancing of the sheet is only carried out a short distance whereafter the activation of the roller means 23, 24 is interrupted again. The front end of the sheet 9 is then reliably retained in the clamping slit 22. Now the lower guiding wall 17 is moved downwards into its vertical position, cf. FIG. 8, in which it no longer supports the sheet 9 being subjected to a printing.

Figure 9:
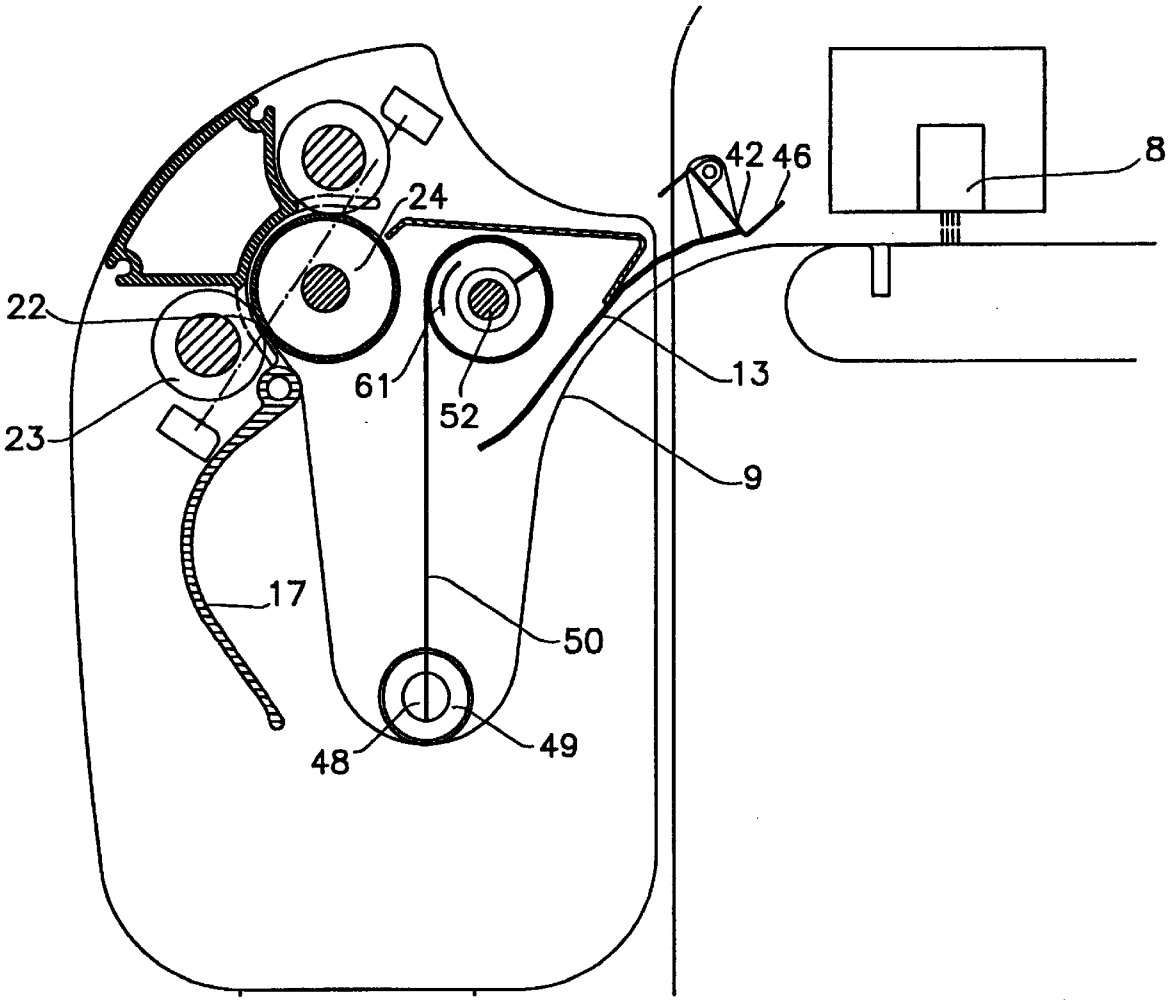

During the continued advancing of the sheet 9, said sheet 9 gradually forms a downward curve in the free space below the upper guiding wall 13, cf. FIG. 9. While the lower guiding wall 17 is tilted downwards into its vertical position, the motor 53 associated with the roller 49, cf. FIG. 4, is activated. As a result, the roller 49 is moved downwards into contact with the sheet 9 by a force being a combination of the weight of said roller and an oppositely acting force from the two helically wound flat springs 50 in which said roller 49 is suspended. When the shaft 52 is caused to rotate by the motor 53 in the direction indicated by means of an arrow 61, the roller 49 is lowered until it enters contact with the sheet 9 as described above. When the motor rotates at a higher speed than the speed involving the formation of the downward curve, the associated overrunning clutch 54 declutches the connection with the motor. The combined force effect by the helically wound flat springs on the roller 49 and the associated shaft 48 is lower than the force of the gravity on said roller 49 and the associated shaft 48. Therefore the roller subjects the sheet 9 to a force, but this force is lower than the force originating from the gravity alone. The effect of the roller 49 on the sheet implies that said sheet is maintains a good curved shaped without forming longitudinal folds although the properties of the paper can be uneven due to a nonuniform distribution of moist areas resulting from the printing.

Figure 10:
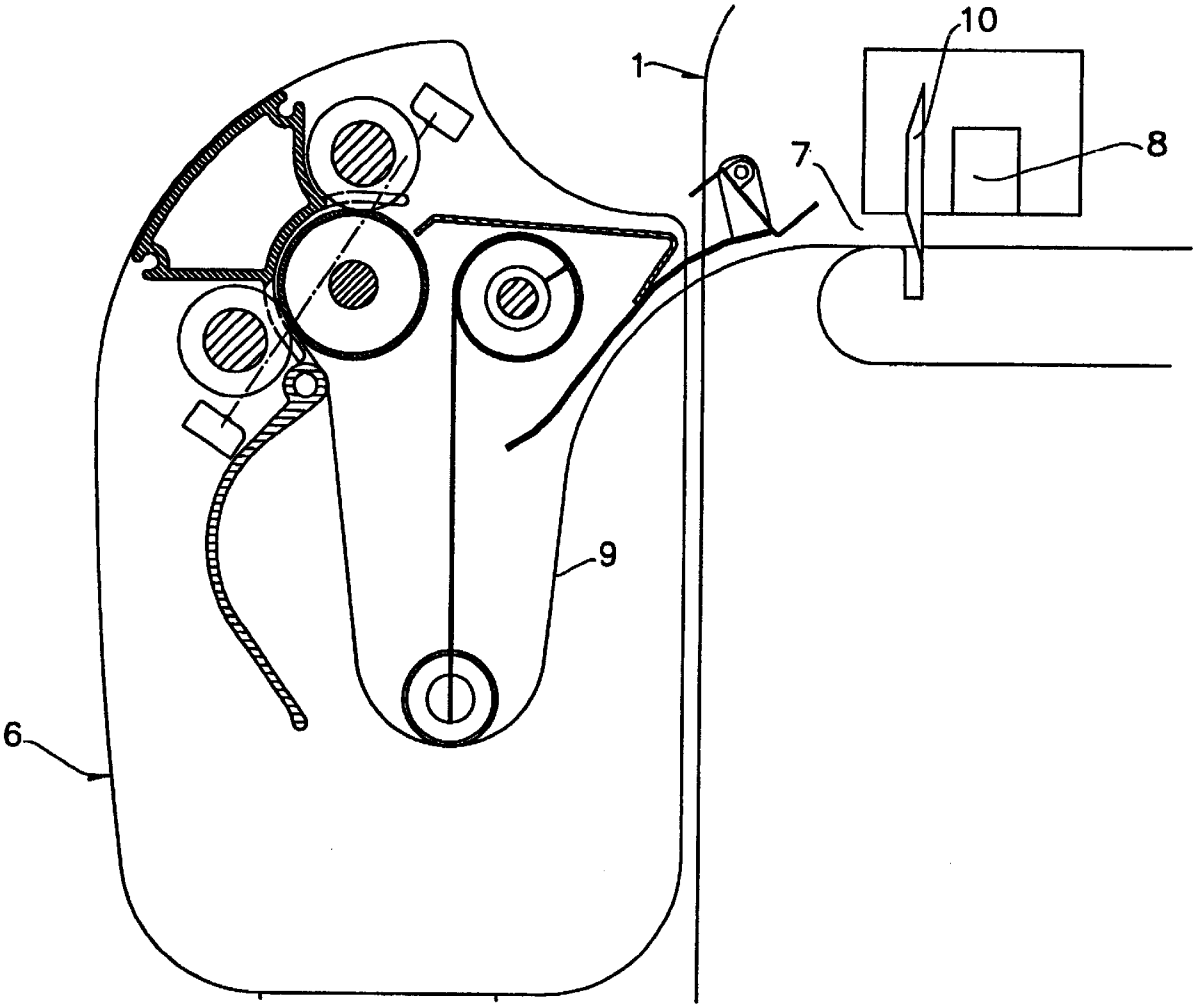
Figure 11:
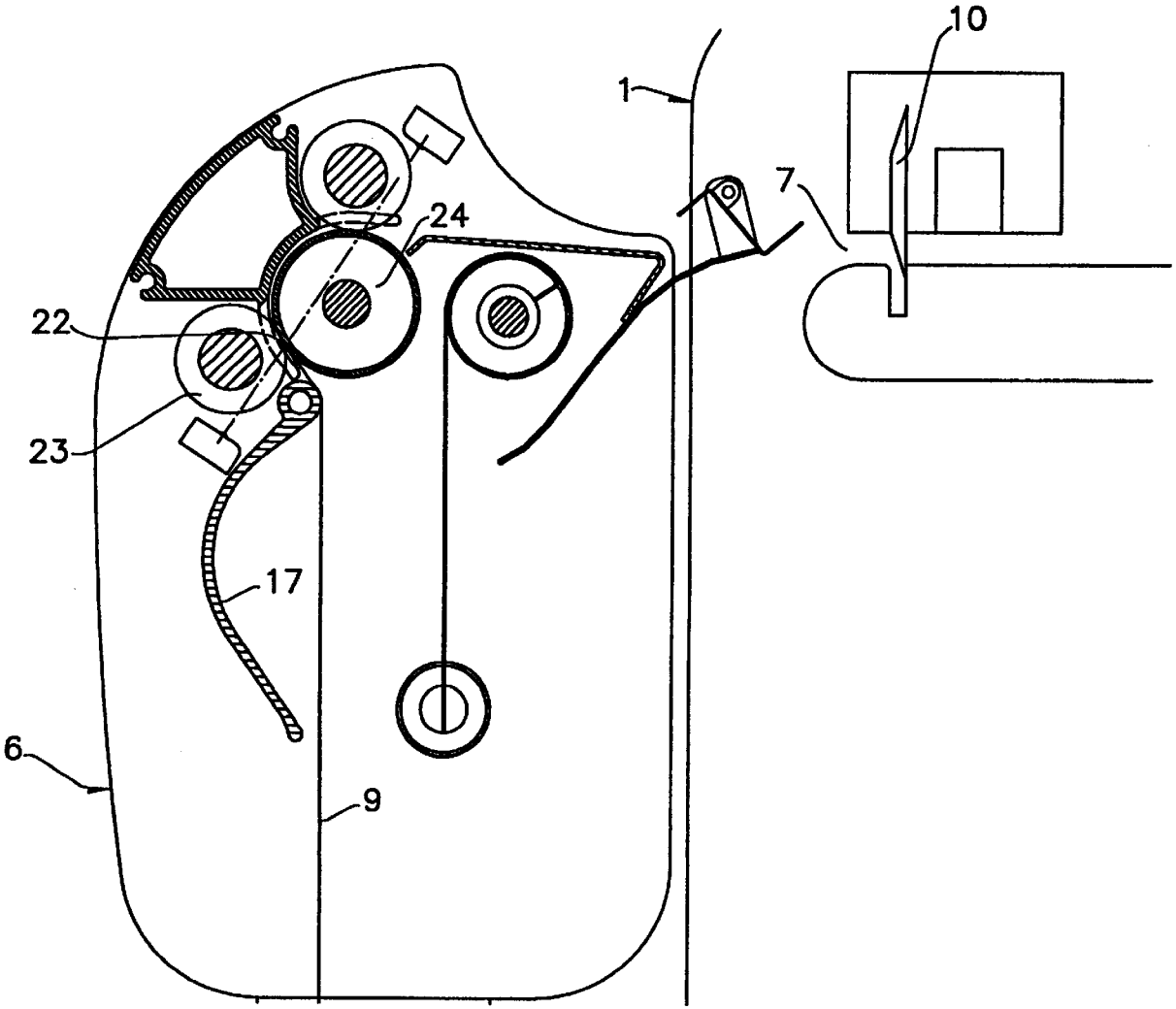
FIG. 11 illustrates a subsequent situation, where the sheet is hanging freely downwards inside the apparatus from the first pair of rollers, FIG. 12 corresponds to FIG. 11, but in an immediately subsequent situation where the pair of rollers of the apparatus has been activated and is about to return the sheet to the printer, FIG. 13 corresponds to FIG. 12, but in a situation where the sheet enters the printer, FIG. 14 corresponds to FIG. 13, but in a subsequent situation where the sheet has been returned completely to the printer and is leaving said printer while the rear side is being printed, and FIG. 15 corresponds to FIG. 14, but in a subsequent situation where the sheet is moving downwards to a tray below the printer.

When the sheet 9 has been completely printed, it is cut off when it originates from a roll of paper by means of the cutting device 10, cf. FIG. 10. Then the rear end of the sheet falls, cf. FIG. 11, while the front end is retained in the clamping slit 22. The rear end of the sheet 9 is optionally placed in a tray not shown below the printer 1.

Figure 12:
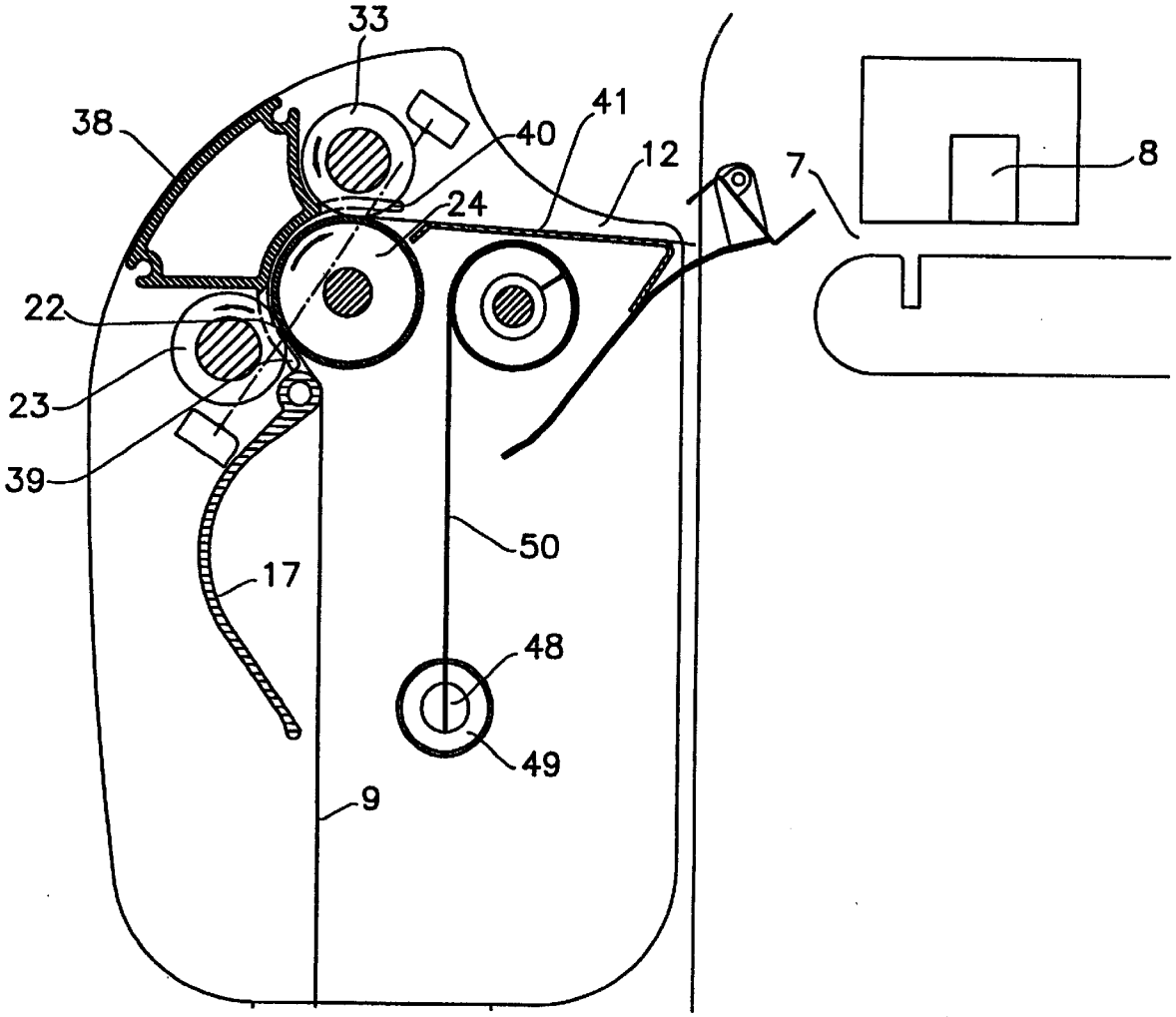
Figure 13:
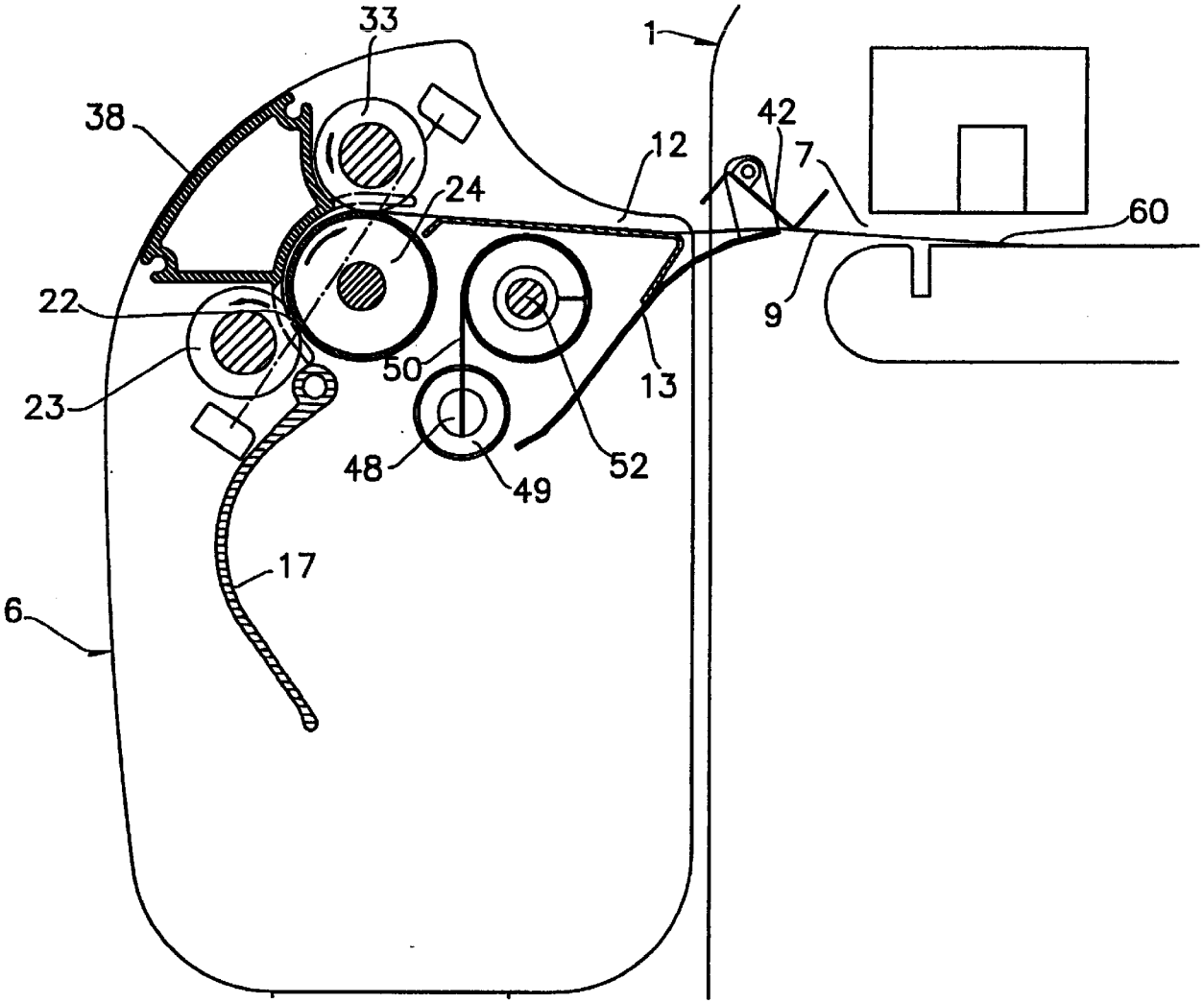

The termination of the printing process activates the apparatus 6 to initiate the returning of the sheet 9 to the printer after a suitable period of time from the front side through the slit 7. This activation implies that the driving roller means 23, cf. FIG. 12, is caused to rotate in the direction indicated by means of the arrows. The primary function of the third roller means during this advancing of the sheet 9 is to measure the current advancing length of the sheet 9, which is carried out by means of a measuring device not shown which registers the revolutions of the third roller means 33. The measuring is carried out in order to take into account possible factors having an effect on the advancing process, such as the weight of the paper, the length of the sheet 9 etc.

During the advance the sheet 9 is guided by the guiding profile 38 and the associated webs 39 and 40 as well as the guide rail 41. When the front end 60 of the sheet reaches the Z-shaped guide rail 42, said guide rail is tilted, cf. FIG. 13, away from its abutment against the upper guiding wall 13. When the front edge 60 of the sheet reaches a specific area in the slit 7 of the printer 1, the advancing mechanisms of the printer are activated, said advancing mechanisms including a vacuum effect and a rotation of rollers. The printer 1 reacts in the same manner as when a sheet is manually fed into the slit 7 from the front of the printer. The arrival of the front edge 60 to this specific area in the slit 7 of the printer 1 is registered by means of the measuring device associated with the third roller means 33, said measuring device measuring the length of the sheet 9 passing the roller means in question as described above. While the sheet 9 is pulled in a direction back to the printer 1, the rotation of the motor associated with the roller 49 is simultaneously initiated with the result that the roller is moved upwards and back to its starting position. Now the printer continues to pull the sheet inwards until it registers the arrival of the rear end of said sheet, which subsequently is the front end during the printing of the rear side of the returned sheet 9.

The sheet is subjected to a tension because it is affected by both the advancing system of the printer during the feeding through the slit 7 and the roller means 23, 24 and 33, and in order to reduce this tension the overrunning clutch 29 associated with the driving roller 23 allows the roller means to rotate freely in the advancing direction in connection with said tension. In order to simultaneously allow a returning a short distance of the sheet during the feeding process because the advancing mechanism of the printer sometimes subjects said sheet 9 to a returning movement during said feeding process, the rotating direction of the motor 26 of the driving roller means 23 is reversed during the initial phase of the feeding of said sheet into the slit 7.

Figure 14:
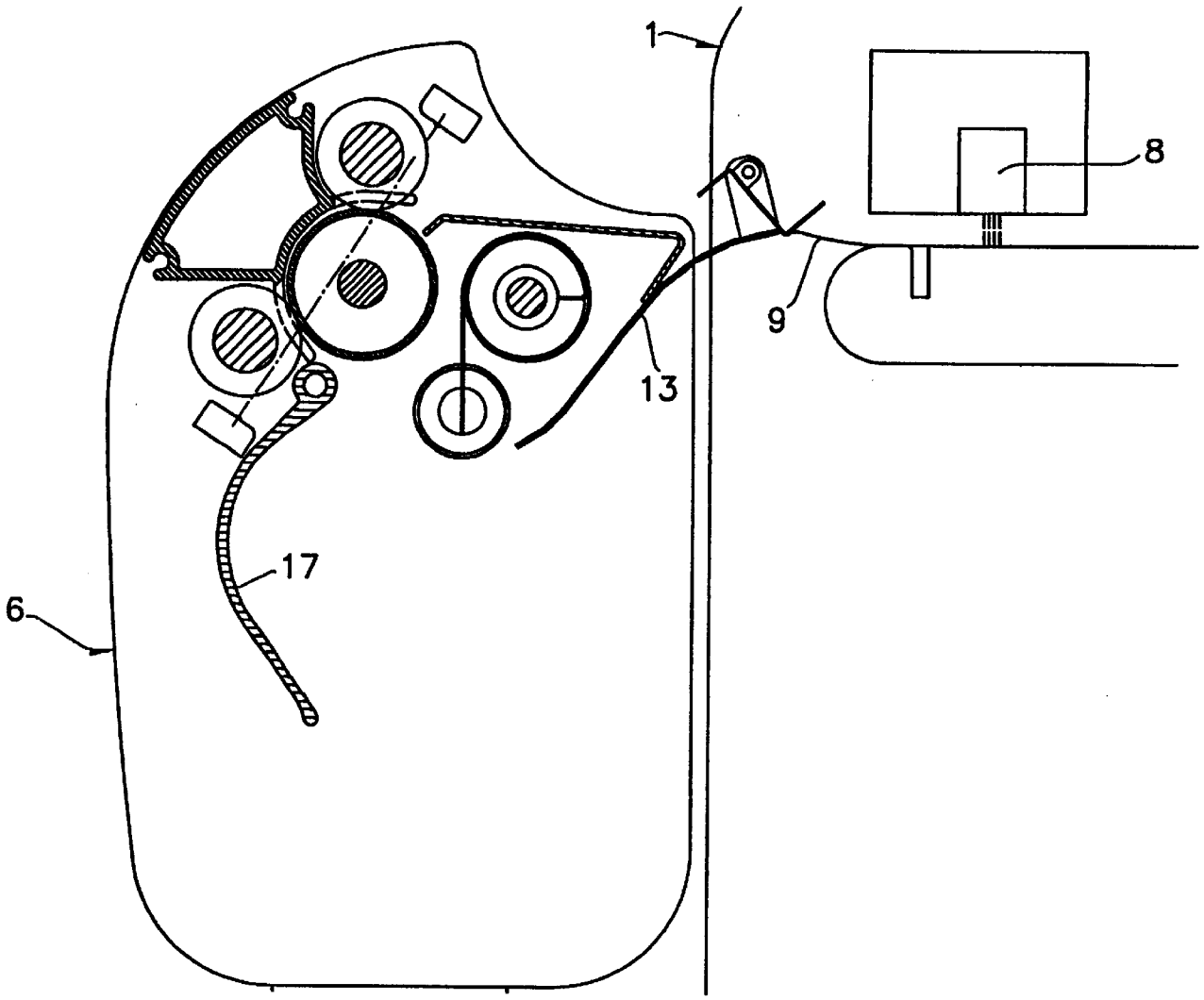

When the printer 1 has registered the arrival of the rear edge of the sheet 9, the printing of the rear side of said sheet 9 is initiated by means of the printer unit 8, cf. FIG. 14, while said sheet 9 is simultaneously guided out of the printer again. As illustrated in FIG. 14, the lower guiding wall 17 is maintained in the vertical position during the latter operation. As a result the front end of the sheet is not gripped in the guiding slit 18 of the apparatus 6 like in FIG. 5, but instead it moves downwards towards the tray optionally arranged therebelow, cf. FIG. 15. When the printing of the rear side of the sheet 9 has been terminated, and when the printer has again been activated to carry out a duplex printing, the lower guiding wall 17 of the apparatus 6 is returned to the horizontal position shown in FIGS. 2 and 5 with the result that the entire apparatus 6 is ready for initiating another inverting of a sheet.

The invention has been described in connection with a preferred embodiment. Many modifications can be carried out without thereby deviating from the scope of the invention. Pneumatic pistons not shown can for instance be incorporated in the arms 4, 5 of the apparatus, said pneumatic pistons allowing the apparatus to be tilted according to desire into a position in which an easy access is provided to the side facing the printer.

What is claimed is:

1. Apparatus for inverting and returning sheets (9) from a printer (1) for large-sized paper, said apparatus comprising an inlet area (11) where the sheet (9) is received from the printer (1), and an outlet area (12) where said sheet (9) is returned to the printer (1), a front edge (60) of the sheets (9) remaining in front during the receiving, inverting and returning movement of said sheets (9), characterised in that the apparatus comprises a frame (16) mountable on the support (2) of the printer, and a guiding slit (18) in the inlet area (11), said guiding slit (18) being defined by a downward surface on an upper guiding wall (13) and an upward surface on a lower guiding wall (17), where said upward surface having a downwardly curving profile extends from the inlet area (11) to a clamping slit (22) between a first pair of roller means (23, 24), whereby the lower guiding wall (17) is tiltable and adapted to be moved about a substantially horizontal axis from a sheet-supporting and -forming position in which the guiding slit (18) is formed and into a downwardly extending sheet-releasing position, that in use the outlet area (12) is placed over and adjacent the inlet area (11), and that the frame carries a second pair of roller means (33, 24) adapted to receive the sheet from the first pair of roller means (23, 24) and to guide the sheet (9) through the outlet area (12) and back to the printer (1).

2. Apparatus as claimed in claim 1, characterised in that it comprises an idler roll (49) adapted to abut the top side of the sheet (9) between the inlet area (11) and the first pair of roller means (23, 24) after the front edge (60) of the sheet has been gripped by the first pair of roller means (23, 24) and the lower guiding wall (17) has been tilted downwards into the downwardly extending position, said idler roll (49) being supported by the sheet (9) and following said sheet in its downwardly curving free path as said sheet leaves the printer (1).

3. Apparatus as claimed in claim 1 or 2, characterised in that the idler roll (49) is suspended in a spring means (50, 51,

52), which ensures that the idler roll (49) subjects the sheet (9) to a force which is weaker than the force originating from the weight of the idler roll (49), and that said spring means (50, 51, 52) is connected to a driving means (53) for retracting the idler roll (49) into its uppermost starting position when the rear end of the sheet (9) has passed through the inlet area (11) and has fallen down.

4. Apparatus as claimed in claim 1, 2 or 3, characterised in that the two pairs of roller means (23, 24, 33) comprise a common roller (24) and are driven by means of the roller means (23) co-acting therewith in the first pair of roller means (23, 24).

5. Apparatus as claimed in claim 1, 2, 3 or 4, characterised in that it comprises a first sensor (55, 56) for detecting the arrival of the front edge (60) of a sheet (9) immediately before said edge reaches the clamping slit (22) between the first pair of roller means (23, 24) and for activating the first pair of roller means (23, 24) so as to grip and advance said edge a short distance.

6. Apparatus as claimed in one or more of the claims 1 to 5, characterised in that it comprises a second sensor for detecting that the rear end of the sheet (9) has left the printer (1).

7. Apparatus as claimed in one or more of the claims 1 to 6, characterised in that a measuring device is associated with the second pair of roller means (33, 24), said measuring device registering the length of the sheet.

8. Apparatus as claimed in one or more of the claims 1 to 7, characterised in that the roller means (23, 24, 33) are provided with overrunning clutches so as to ensure that the sheet can be pulled freely forwards in the advancing direction when the advancing device of the printer (1) starts to advance the inverted sheet (9).

9. Apparatus as claimed in one or more of the claims 1 to 8, characterised in that a redirecting member (42) is provided for directing the front edge of a sheet at the guiding slit (18) in a direction downwards and into said guiding slit (18) at the arrival from the printer (1).

10. Apparatus as claimed in claim 9, characterised in that the redirecting member (42) comprises a Z-shaped sectional guide freely pivotally journalled about a horizontal axis above the outlet area (12), where the body of said Z-shaped sectional guide in the rest position extends obliquely downwards and abuts by its lower end the edge of the upper guiding wall (13) of the guiding slit (18) adjacent the printer (1), and together with this guiding wall (13) it forms an acute angle facing the outlet area (12) while the lower web (46) of the sectional guide projects obliquely upwards from the guiding wall (13) towards the printer (1).

11. Apparatus as claimed in one or more of the claims 1 to 10, characterised in that the frame (16) is tiltably and detachably mounted on the support (2) of the printer (1).

12. Apparatus as claimed in one or more of the claims 1 to 11, characterised in that an additional guide (38, 41) is provided between the two pairs of roller means (23, 24, 33) and the second pair of roller means (24, 33) and the outlet area (12), respectively.

* * * * *